US006491536B1

(12) United States Patent
Torii

(10) Patent No.: US 6,491,536 B1
(45) Date of Patent: Dec. 10, 2002

(54) CONNECTOR FOR USE ON BOARD

(75) Inventor: Chieko Torii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/453,902

(22) Filed: Mar. 31, 2000

(30) Foreign Application Priority Data

Apr. 28, 1999 (JP) ..... 11-122752

(51) Int. Cl.[7] ..... H01R 13/64

(52) U.S. Cl. ..... 439/246; 439/79; 439/83; 439/686; 439/733.1; 439/848

(58) Field of Search ..... 439/79, 686, 695, 439/848, 246, 82, 83, 733.1

(56) References Cited

U.S. PATENT DOCUMENTS 4,007,977 A * 2/1977 Bauerle ..... 339/217
4,762,500 A * 8/1988 Dola et al. ..... 439/79
5,186,633 A * 2/1993 Mosser, III ..... 439/79

* cited by examiner

*Primary Examiner*—P. Austin Bradley
*Assistant Examiner*—Truc Nguyen
(74) *Attorney, Agent, or Firm*—Finnegan, Henderson, Farabow, Garrett & Dunner, L.L.P.

(57) ABSTRACT

A connector has a housing mounted on a board, and a terminal retained within the terminal accommodation chamber. The housing has a terminal accommodation chamber. The terminal has a hollow-cylindrical connectable portion, into which a corresponding connection pin is inserted, and a leg plate extended from the connectable portion toward the board. The leg plate has a first plate portion extended from the connectable portion and a second plate portion substantially perpendicular to the first plate portion. The first and the second plate portion are partly connected to each other, and the second plate portion is connected to the board.

12 Claims, 7 Drawing Sheets

60
61
11B
10
11
11A
12A
12
13A
13
Y
X
Z

CONNECTOR FOR USE ON BOARD

BACKGROUND OF THE INVENTION

The present invention relates to a connector for use on a board and, more particularly, to a connector that is mounted on, for example, a printed circuit board.

A conventional connector mounted on a board has a terminal fused to the board.

However, when the connector mounted as above is slightly moved relative to the board and the terminal within this connector is moved following this movement thereof, the following inconvenience occurs. Namely, there is the possibility that cracks or fractures will occur in the fused portion between the board and the terminal, with the result that a state of electrical connection therebetween becomes unstable.

FIELD OF THE INVENTION

Not Applicable

SUMMARY OF THE INVENTION

Thereupon, it is an object of the present invention to provide a connector that is simple in structure and has a high reliability on the electrical connection.

To attain the above object, a connector according to a first aspect of the present invention has a housing mounted on a board and a terminal retained in a terminal accommodation chamber. The housing has the terminal accommodation chamber. The terminal has a hollow-cylindrical connectable portion, into which a corresponding connection pin is inserted, and a leg plate extending from the connectable portion toward the board. The leg-plate has a first plate portion extending from the connectable portion and a second plate portion substantially perpendicular to the first leg portion. The first plate portion and the second plate portion are partly connected to each other, and the second plate portion is connected to the board.

According to this construction, the leg plate of the terminal has the first plate portion and the second plate portion substantially perpendicular to the first plate portion, and the first and the second plate portion are partly connected to each other. And in addition the second plate portion is connected to the board. Therefore, when the terminal has received a stress acting thereon from a direction perpendicular to the first plate portion thereof, the first plate portion is deformed to thereby mitigate this stress. When the terminal has received a stress acting thereon from a direction perpendicular to the second plate portion thereof, the second plate portion is deformed to thereby mitigate this stress. In this way, the stresses acting at least from the two directions are mitigated by the first and the second plate portion. Accordingly, a stable state of electrical connection is obtained, whereby the reliability of this construction is enhanced.

A second aspect of the present invention is the connector wherein in the first aspect of connector the second plate portion is bent from the first plate portion.

According to this construction, the second plate portion is bent in a direction different from that in which the leg plate is extended. Therefore, the second plate portion is easily bent, whereby the workability of the terminal is enhanced.

A third aspect of the present invention is the connector wherein in the first aspect of connector the first plate portion has a stopper piece that externally protrudes and the housing has a slit into which the stopper piece is inserted.

According to this construction, the stopper piece of the first plate portion is inserted into the slit and is thereby retained. Therefore, the backlash of the terminal within the housing is suppressed. Therefore, the position of one of the housing and the terminal relative to the other is easily and reliably set, whereby the connector is easily connected to the board.

A fourth aspect of the present invention is the connector wherein in the first aspect of connector the second plate portion has a spring portion that is bent.

According to this construction, the spring portion mitigates the stress acting in the longitudinal direction (the direction in which the leg plate is extended) of the terminal. For this reason, when the terminal within the housing has received a stress acting in a direction perpendicular to the board in a state of its having been connected onto the board, the spring portion absorbs the stress and mitigates the same. Accordingly, the stress acting in the three directions are mitigated with the result that a more stable state of electrical connection is obtained, whereby the reliability on the connector is enhanced.

A fifth aspect of the present invention is the connector wherein in the fourth aspect of connector the second plate portion is bent from the first plate portion.

According to this construction, the bending direction of the spring portion and the bending direction of the second plate portion relative to the first plate portion differ from each other. Therefore, it is possible to simultaneously perform the bending of the both without impairing the dimensional precision after the bending thereof. Accordingly, it is possible to provide the terminal that is easy to work and high in precision.

A sixth aspect of the present invention is the connector wherein in the first aspect of connector the housing is constructed of a housing main body and a spacer block. The terminal accommodation chamber is formed in the housing main body. With the terminal being inserted into the terminal accommodation chamber from a side opposite to that on which the connection pin is inserted into the connectable portion, the spacer block is assembled to the housing main body. As a result of this, the spacer block stops the draw-off of the terminal; the connectable portion is retained by the housing main body; and the leg plate is retained by the spacer block.

According to this construction, the connector is provided through the easy operation of the spacer block being assembled to the housing main body after the insertion of the terminal into the terminal accommodation chamber. Also, in this construction, the position at which the stress is generated in the terminal is dispersed into two positions, i.e., the interior of the housing and the interior of the spacer block. Therefore, compared to a case where the stress-generation position is concentrated on one member, the stress is unlikely to directly act on the second plate portion. Therefore, the durability of the portion of connection of the second plate portion and the board is further enhanced.

A seventh aspect of the present invention is the connector wherein in the sixth aspect of connector the first plate portion has an externally protruding stopper piece; and the spacer block has a slit having the stopper piece inserted therein.

According to this construction, the second plate portion is disposed at a proper position by inserting the stopper piece into the slit of the spacer block after the accommodating of the connectable portion of the terminal into the housing main body.

An eighth aspect of the present invention is the connector wherein in the third aspect of connector the housing has a rib protruding along the slit.

According to this construction, with the stopper piece of the first plate portion being inserted in the slit, the rib retains the first plate portion. Therefore, a backlash is prevented from occurring in the second plate portion, whereby a stable connection structure is provided.

DESCRIPTION OF THE PREFERRED EMBODIMENTS

Figure 1:
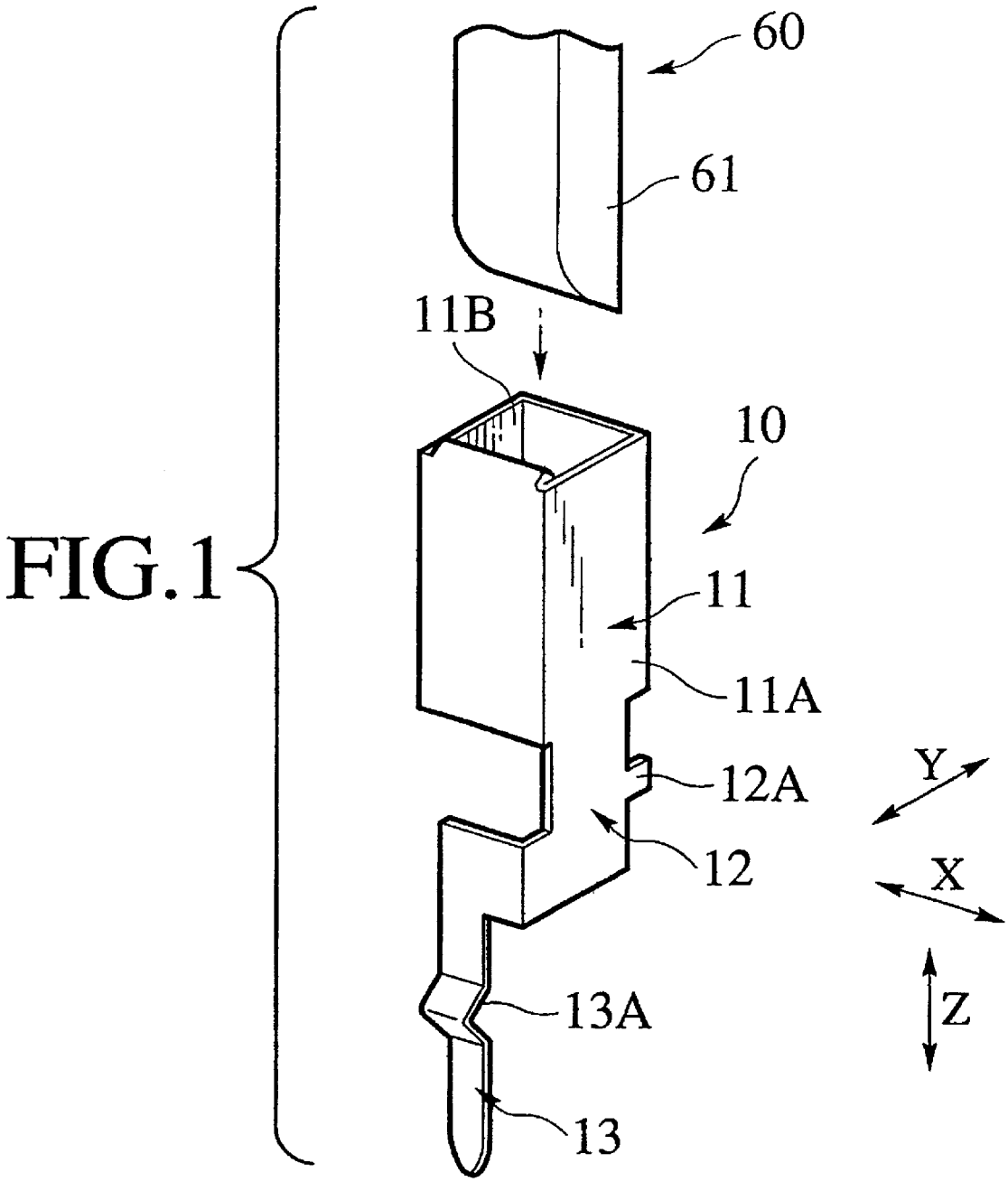
FIG. 1 is a perspective view illustrating a terminal according to an embodiment of the present invention.

A detail of a connector 40 for use on connection thereof to a board according to the present invention will be explained on the basis of an embodiment illustrated in the drawings.

The connector 40 is equipped with a terminal 10, a main body 20 of a housing, and a spacer block 30.

FIG. 1 illustrates the terminal 10 that is accommodated and retained within the connector 40. The terminal 10 has an angular-hollow-cylindrical connectable portion 11, a first plate portion 12 that is downwardly extended from one side plate 11A of the connectable portion 11, and a second plate portion 13 that is orthogonally bent from one side edge at a lower end of the first plate portion 12 and that is downwardly extended.

Within the connectable portion 11 there is accommodated a connection piece 11B that has been folded back from an upper end thereof. The connection piece 11B is pressure-contacted with a connection pin 61 of a male connector 60 that has been inserted into the connectable portion 11.

One side edge of the first plate portion 12 continues on the second plate portion 13 while the other side edge thereof has a stopper piece 12A protruding laterally. The stopper piece 12A is inserted into a slit 31 of the spacer block 30 as later described.

At an intermediate portion of the second plate portion 13 there is formed a spring portion 13A that has been bent so as to protrude on one surface side thereof and that is substantially shaped like a character "V". The spring portion 13A performs its shock-absorbing function when a stress acting in the longitudinal direction has been applied to the terminal 10.

Figure 2:
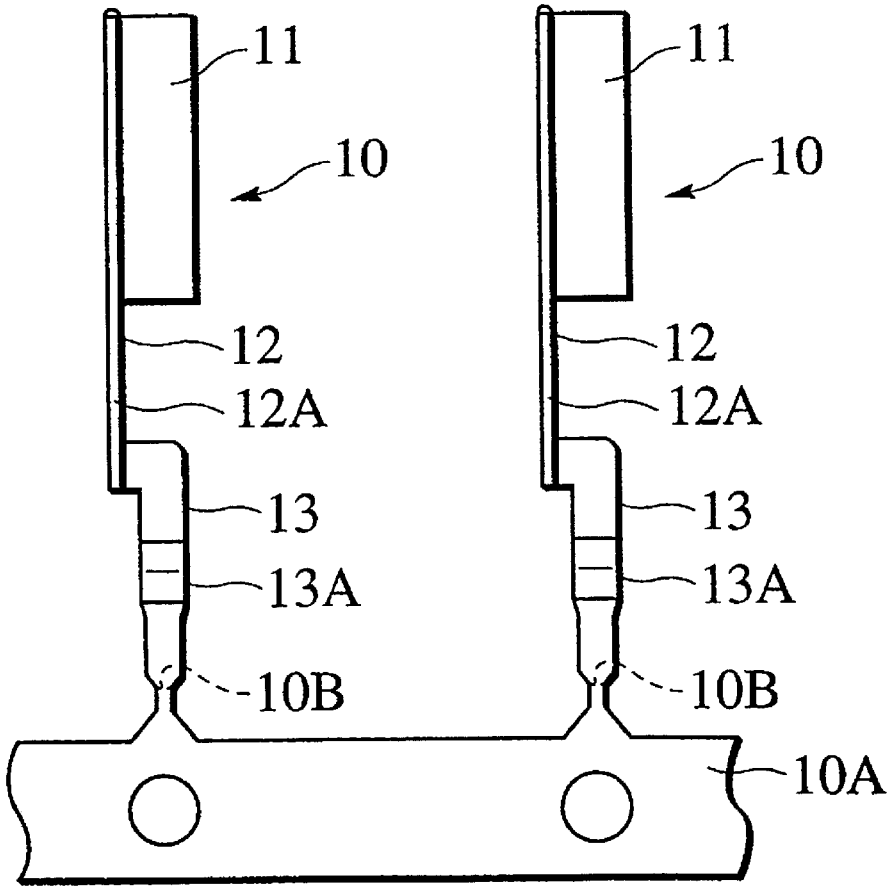
FIG. 2 is a plan view illustrating a state where the terminal of FIG. 1 is in the course of manufacture.

The terminal 10 is formed in a multi-piece fashion on a frame 10A as illustrated in FIG. 2 by punching out a metal plate and then performing bending of the resulting metal plate. The terminal 10 is used by being separated from the frame 10A by being cut along a broken line 10B.

Next, an assembling method and a structure of the connector 40 will be explained using FIGS. 3 to 7.

Figure 3:
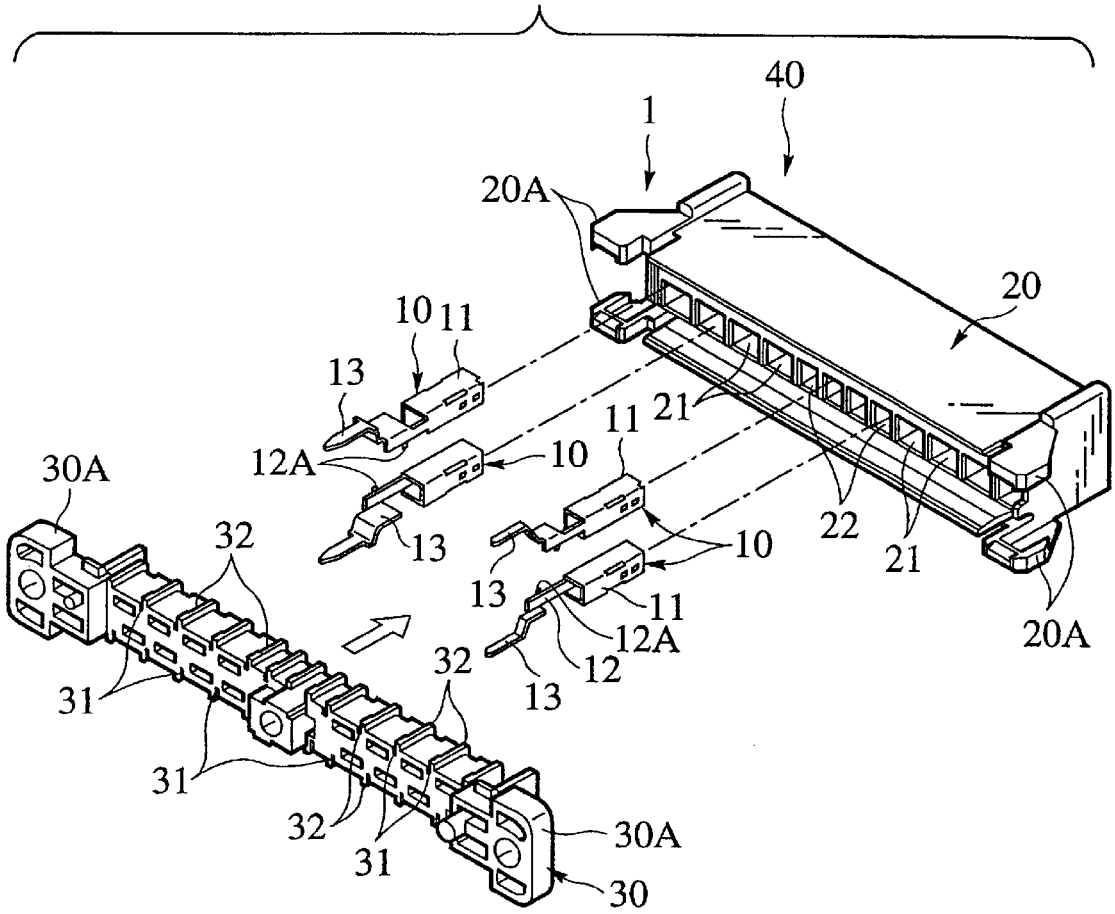
FIG. 3 is an exploded perspective view illustrating a connector according to an embodiment of the present invention.

As illustrated in FIG. 3, the housing main body 20 has a plurality of terminal accommodation chambers 21 that are arrayed in two rows. The connectable portion 11 of the terminal 10 is inserted into the terminal accommodation chamber 21. The terminal accommodation chamber 21 passes through the housing main body 20. Adjacent two of the terminal accommodation chambers 21 are electrically isolated from each other by a partitioning wall 22. The terminal accommodation chamber 21 is set to have a dimension that prevents a backlash from occurring in the connectable portion 11 that has been inserted in and accommodated within the chamber 21. The terminal 10 is disposed within the housing main body 20 so that the stopper piece 12A in the first row and the stopper piece 12A in the second row may oppose each other.

The spacer block 30 is contacted with one end surface of the housing main body 20, at which the terminal accommodation chamber 21 is open. With the connectable portion 11 being accommodated in the housing main body 20, the spacer block 30 retains the first plate portion 12 and second plate portion 13 of the terminal 10. The spacer block 30 has the slit 31 formed at the position corresponding to the stopper piece 12A of the terminal 10 within the housing 20, the slit 31 having the stopper piece 12A inserted therein. The spacer block 30 has a rib 32 linearly protruding from an edge of the slit 31. The rib 32 contacts with a side surface of the first plate portion 12 and retains the posture of the first plate portion 12 as it is.

On respective side surfaces of the housing main body 20 and the spacer block 30 there are provided engaging portions 20A and 30A that are engaged with each other.

Figure 4:
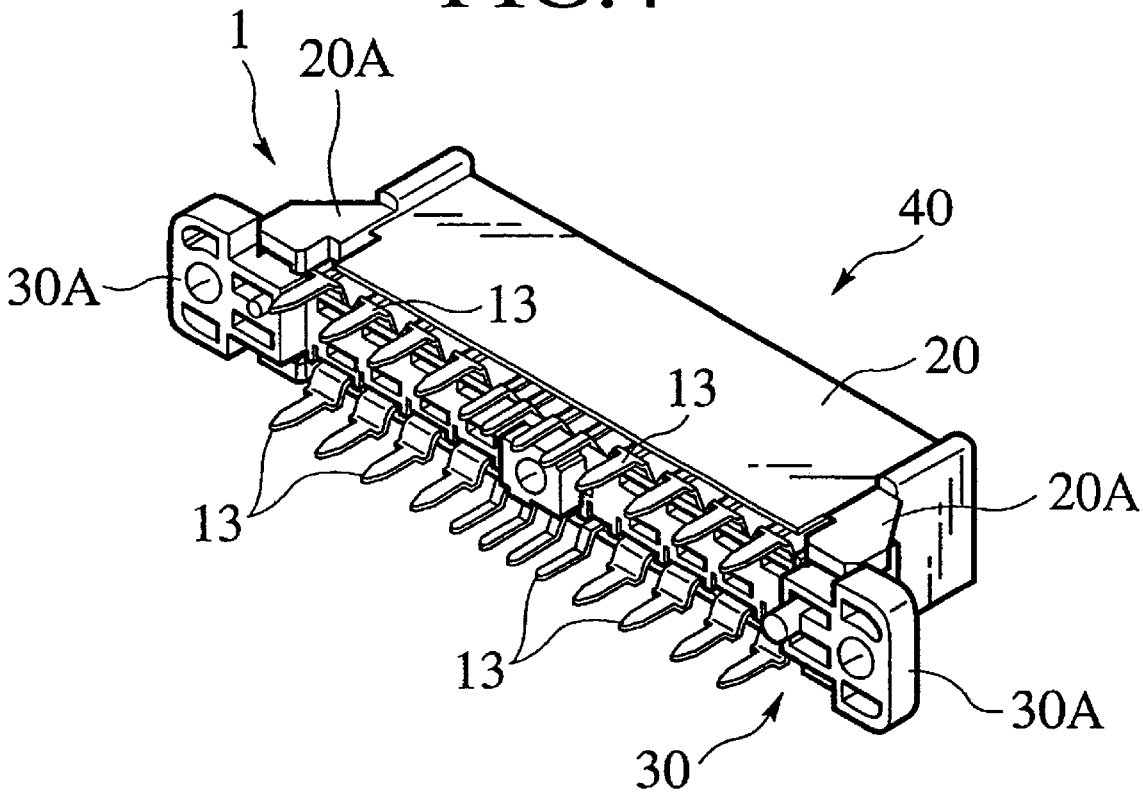
FIG. 4 is a perspective view illustrating the entire connector of FIG. 3.
Figure 5:
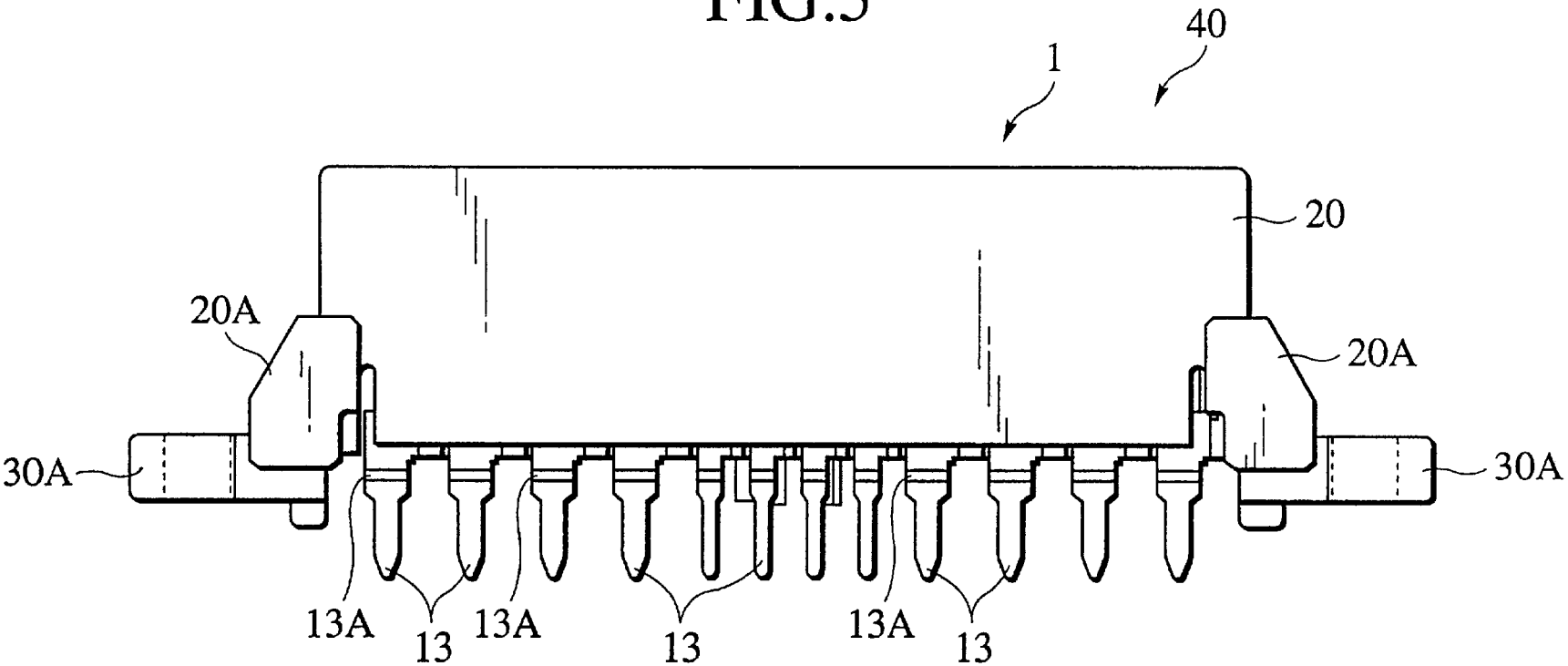
FIG. 5 is a front view illustrating the connector of FIG. 3.
Figure 7:
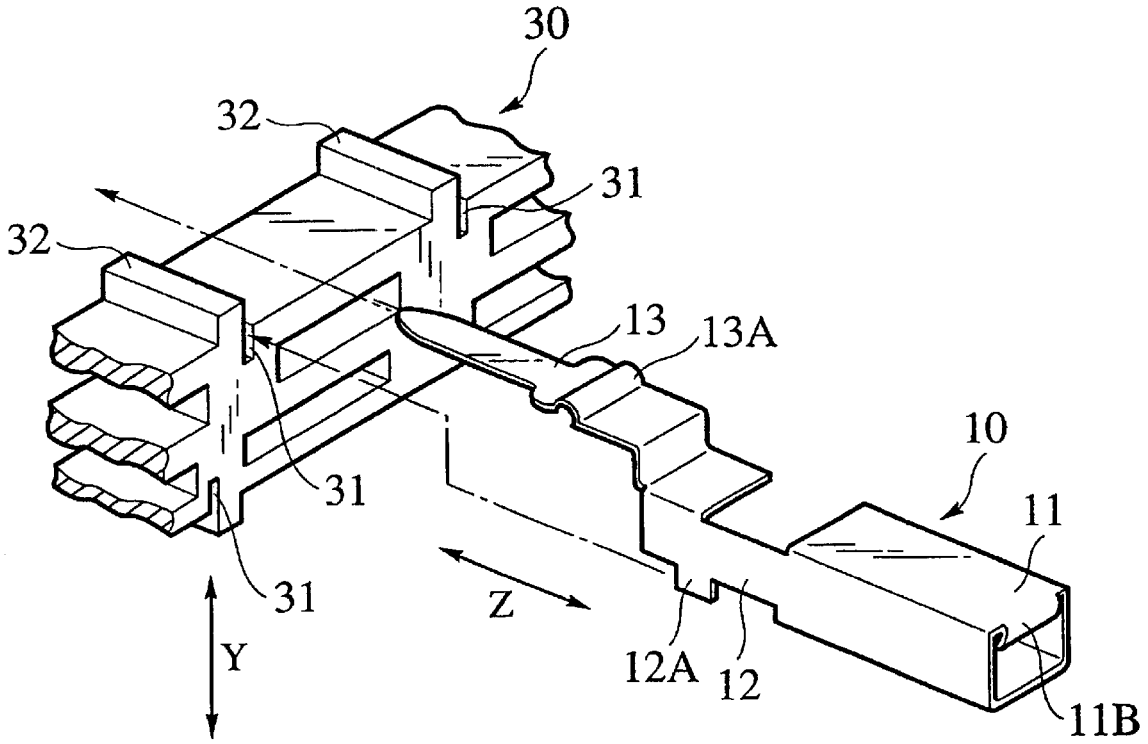
FIG. 7 is a perspective view illustrating a main part of the connector of FIG. 3.

When mounting the terminal 10 to within the housing 1 composed of the housing main body 20 and the spacer block 30, first, the connectable portion 11 of the terminal 10 is inserted into the terminal accommodation chamber 21 of the housing main body 20. Then, the spacer block 30 is assembled to the housing main body 20 in such a way as to be pressed against the main body 20 thereof. At this time, as illustrated in FIG. 7, the stopper piece 12A of each terminal 10 is inserted into its corresponding slit 31 of the spacer block 30. Since the housing main body 20 accurately defines the position of the terminal, the positioning of the stopper piece 12A with respect to the slit 31 is easy. By performing the assembling operation in this way, the connector 40 such as that illustrated in FIGS. 4 or 5 is provided.

Figure 6:
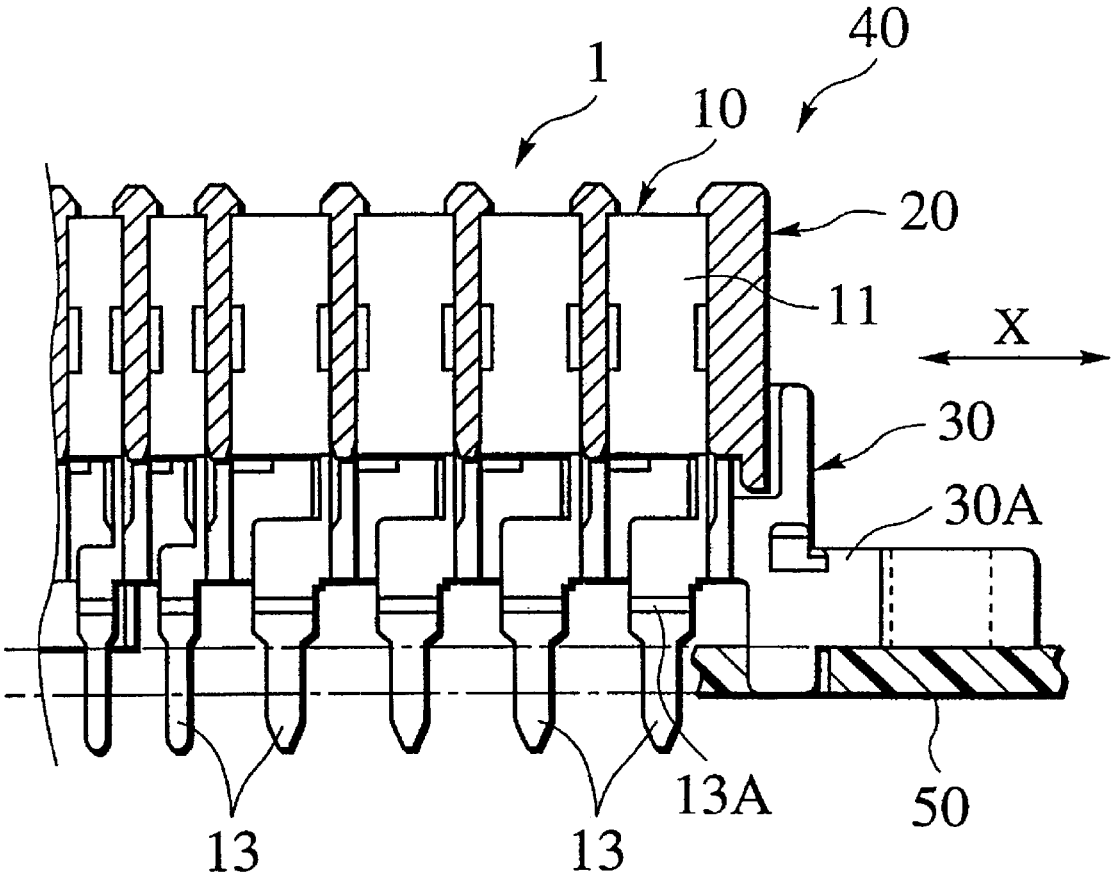
FIG. 6 is a sectional view illustrating a main part of the connector of FIG. 3.

FIG. 6 illustrates a state where the connector 40 has been mounted on a printed circuit board 50. The second plate portion 13 protruding from the spacer block 30 passes through the printed circuit board 50 to reach a reverse surface of the same. A forward end of the second plate portion 13 having reached the reverse surface of the printed circuit board 50 is electrically conduction-connected by solder to a wiring pattern formed on the printed circuit board 50, electric parts on the printed circuit board 50, etc.

Next, the function of the connector 40 of this embodiment will be explained.

When, a centering function (the position-adjusting function) working on the housing main body 20 and the spacer block 30, the housing main body 20 and the spacer block 30 are moved in a direction indicated by an arrow X illustrated in FIG. 6, the terminal 10 also is moved in a way to follow that. At this time, if the first plate portion 12 and the second plate portion 13 exist substantially on the same plane, the portion corresponding to the second plate portion 13 is also moved in accordance with the stress acting in the X direction. As a result of this, there is the possibility that the soldered portion will be impaired. In contrast to this, in the case of the terminal 10 of this embodiment, one of the first plate portion 12 and the second plate portion 13 is bent so as to define an angle of 90 degrees with respect to the other. Therefore, when the terminal 10 has received the stress in the X direction, the first plate portion 12 is flexed whereby the stress is mitigated.

Especially, in this embodiment, the connectable portion 11 is received in and retained by the housing main body 20, and the stopper piece 12A is inserted in and retained by its corresponding slit 31 of the spacer block 30. Therefore, even when relative positional displacement occurs between the housing main body 20 and the spacer block 30 in the X direction, the first plate portion 12 mitigates the stress acting following such positional displacement. For this reason, even when the terminal 10 has received the stress in the X direction, the.stress is greatly prevented from being extended to the second plate portion 13. As a result of this, the occurrence of cracks or fractures in the solder portion between the second plate portion 13 and the printed circuit board 50 is suppressed.

In a case where the terminal 10 has received the stress acting in the Y direction in FIG. 7, this stress is mitigated by the second plate portion 13 being flexed. In a case where the terminal 10 has received the stress acting in the Z direction in FIG. 7, this stress is mitigated by the spring portion 13A of the second plate portion 13 being expanded or contracted.

As described above, according to the connector 40 of the present invention, despite the terminal 10 having a relatively simple configuration, the stress that acts in two or three directions is mitigated. Namely, with the second plate portion 13 being soldered to the printed circuit board 50, the stress acting in every direction, that is applied to the terminal 10, is mitigated. Accordingly, the durability on soldering is enhanced with the result that the highly reliable connector 40 is provided.

As will be apparent from the foregoing description, although an explanation has been given of one embodiment of the present invention, this invention is not limited thereto and permits various changes or modifications incidental to the subject matter of the construction to be made. For example, in the above-described embodiment, an explanation has been given of the construction retaining the terminal 10 by the use of the housing main body 20 and the spacer block 30. However, it is also possible to make up a construction wherein the terminal 10 is received only within the housing main body 20 to thereby omit the use of the spacer block 30. In this case, the slit into which the stopper piece 12A is inserted may be formed in the inner wall of the housing main body 20.

What is claimed is:

1. A connector for use on board, comprising:

a housing mounted on a board, the housing having a terminal accommodation chamber; and a terminal retained within the terminal accommodation chamber, the terminal having a hollow-cylindrical connectable portion into which a corresponding connection pin is inserted and a leg plate extended from the connectable portion toward the board, the leg plate having a first plate portion downwardly extended from the connectable portion and having a stopper piece extending therefrom, and a second plate portion downwardly extended from a lower end of the first plate portion, the first and the second plate portions being substantially perpendicular to each other, and the second plate to be connected to the board, wherein one end of the first plate portion is continued from the connectable portion;

one end of the second plate portion is bent from an end of the first plate portion opposite the stopper piece; and the other end of the second plate portion is fused onto the board.

2. A connector according to claim 1, wherein the second plate portion is bent from the first plate portion.

3. A connector according to claim 1, wherein the second plate portion is fused onto the board.

4. A connector according to claim 1, wherein the housing comprises a housing main body and a spacer block; the terminal accommodation chamber is formed in the housing main body; the first plate portion has a stopper piece that protrudes externally; and the spacer block has a slit into which the stopper piece is inserted.

5. A connector according to claim 1, wherein the second plate portion has a bent spring portion.

6. A connector according to claim 5, wherein the second plate portion is bent from the first plate portion.

7. The connector according to claim 1, wherein the housing comprises a housing main body and a spacer block;

the terminal accommodation chamber is formed in the housing main body; and with the terminal being inserted into the terminal accommodation chamber from a direction opposite to that in which the connection pin is inserted into the connectable portion, the spacer block is assembled to the housing main body, whereby a terminal stopper piece retains the terminal to the spacer block; the connectable portion is retained by the housing main body; and the leg plate is retained by the spacer block.

8. A connector according to claim 7, wherein the first plate portion has a stopper piece that protrudes externally; and the spacer block has a slit into which said stopper piece is inserted.

9. A connector according to claim 4, wherein the spacer block has a rib that protrudes along the slit.

10. A terminal retained within a housing mounted on a board and conduction-connected to the board, the terminal comprising:

a hollow-cylindrical connectable portion into which a corresponding pin is inserted; and a leg plate extended from the connectable portion toward the board, the leg plate having a first plate portion downwardly extended from the connectable portion and having a stopper piece extending therefrom, and a second plate portion downwardly extended from a lower end of the first plate portion, the first plate portion and the second plate portion being substantially perpendicular to each other, the second plate to be connected to the board, wherein one end of the first plate portion is continued from the connectable portion;

one end of the second plate portion is bent from an end of the first plate portion opposite the stopper piece; and the other end of the second plate portion is fused onto the board.

11. A terminal according to claim 10, wherein the first plate portion has a stopper piece that protrudes externally; and the stopper piece is inserted into a slit in the spacer block.

12. A terminal according to claim 10, wherein the second plate portion has a bent spring portion.

* * * * *